US006848437B2

(12) United States Patent
Naruse et al.

(10) Patent No.: US 6,848,437 B2
(45) Date of Patent: Feb. 1, 2005

(54) IGNITION DEVICE FOR AN INTERNAL COMBUSTION ENGINE

(75) Inventors: Yusuke Naruse, Tokyo (JP); Hisanori Nobe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 98 days.

(21) Appl. No.: 10/289,200

(22) Filed: Nov. 7, 2002

(65) Prior Publication Data

US 2004/0000299 A1 Jan. 1, 2004

(30) Foreign Application Priority Data

Jun. 28, 2002 (JP) ..... 2002-189398

(51) Int. Cl.[7] ..... F02P 3/00
(52) U.S. Cl. ..... 123/644; 123/651; 315/209 T
(58) Field of Search ..... 123/644, 650, 123/651; 315/209 T

(56) References Cited

U.S. PATENT DOCUMENTS 4,367,712 A * 1/1983 Sugiura ..... 123/644
6,081,074 A * 6/2000 Frus et al. ..... 315/209 T
6,336,448 B1 * 1/2002 Furuhata et al. ..... 123/651

FOREIGN PATENT DOCUMENTS

| | | |
|---|---|---|
| JP | 62-152077 | 9/1987 |
| JP | 9-280417 | 10/1997 |
| JP | 3186619 | 5/2001 |

OTHER PUBLICATIONS

Patent Abstracts of Japan, Publication No. 2002–135968.
Patent Abstracts of Japan, Publication No. 11–018291.
Patent Abstracts of Japan, Publication No. 55–123362.
Patent Abstracts of Japan, Publication No. 07–259712.

* cited by examiner

*Primary Examiner*—Erick Solis
(74) *Attorney, Agent, or Firm*—Sughrue Mion, PLLC

(57) ABSTRACT

The ignition device for an internal combustion engine includes, a control unit (1) for outputting an ignition signal used to determine a time when an ignition plug (8) should be ignited, a switching unit (5) connected to the other terminal of a primary coil for cutting off the flow of a primary current, and a drive unit (4) for turning ON or OFF the switching unit (5) in response to the ignition signal to adjust a voltage to be applied to a gate of the switching unit (5).

14 Claims, 10 Drawing Sheets

FIG. 11 CONVENTIONAL
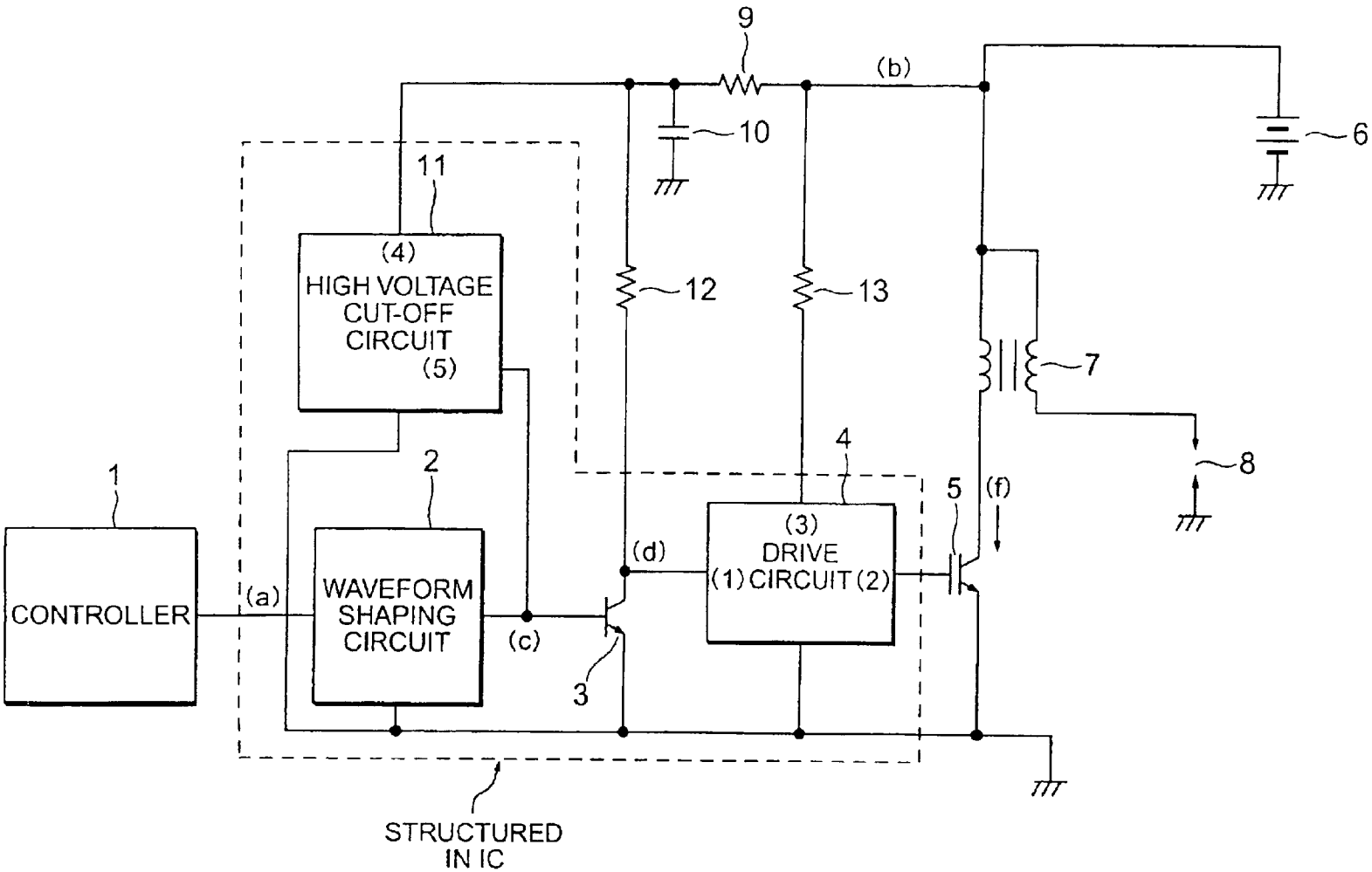

FIG. 12 CONVENTIONAL
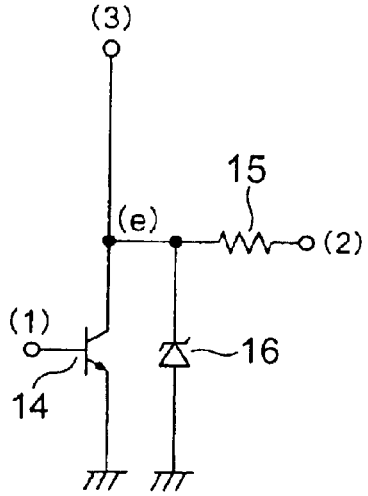
FIG. 13 CONVENTIONAL
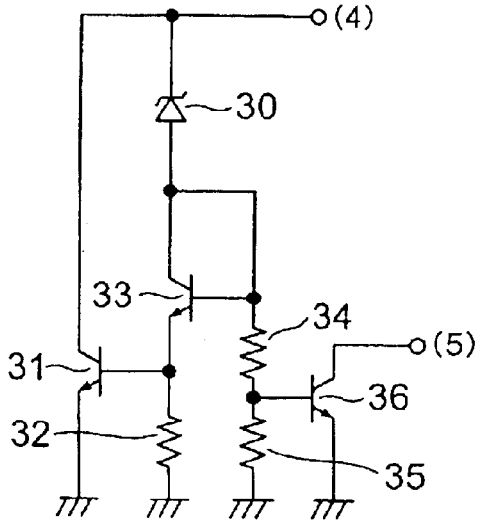

FIG. 14 CONVENTIONAL
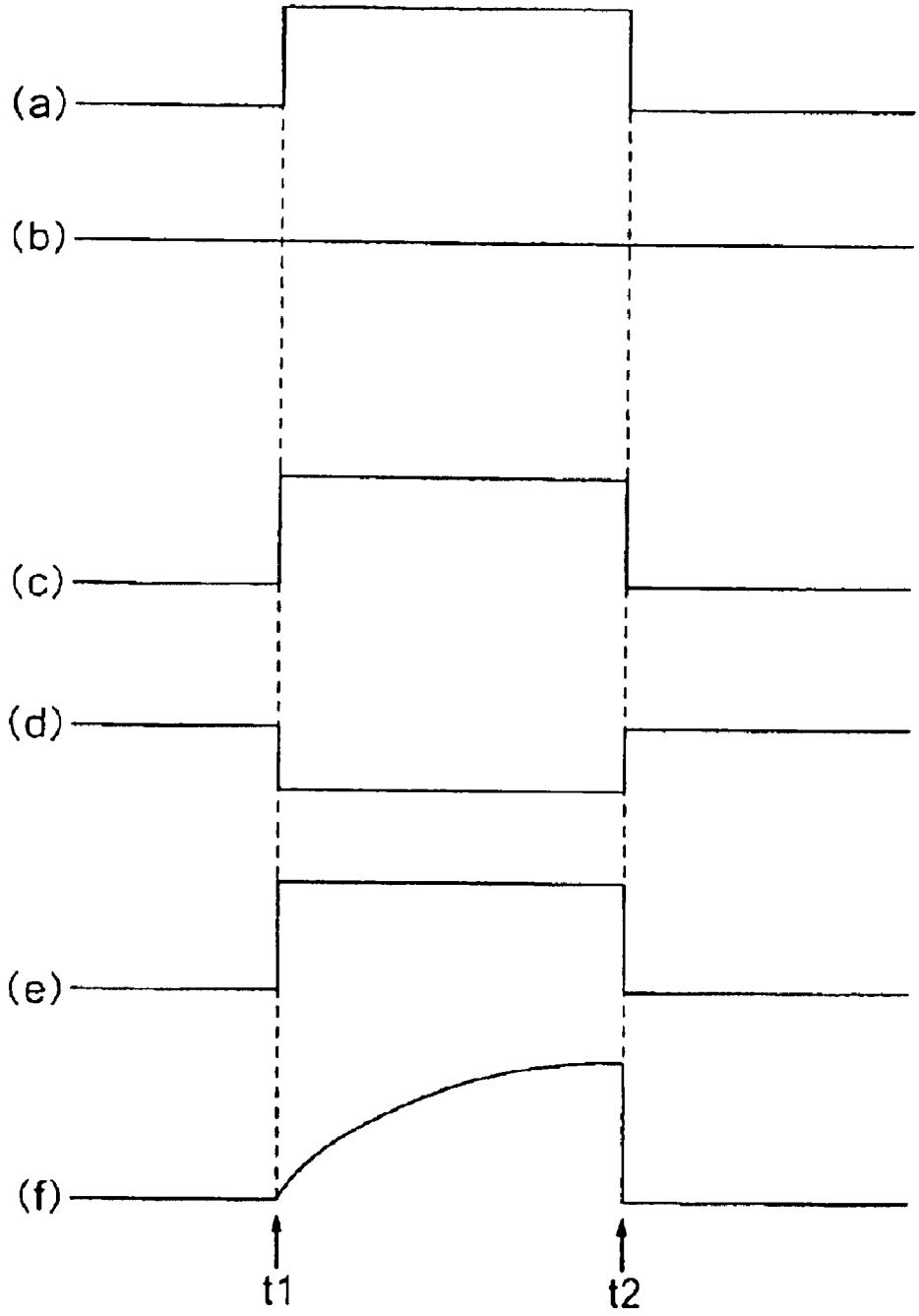

FIG. 15 CONVENTIONAL
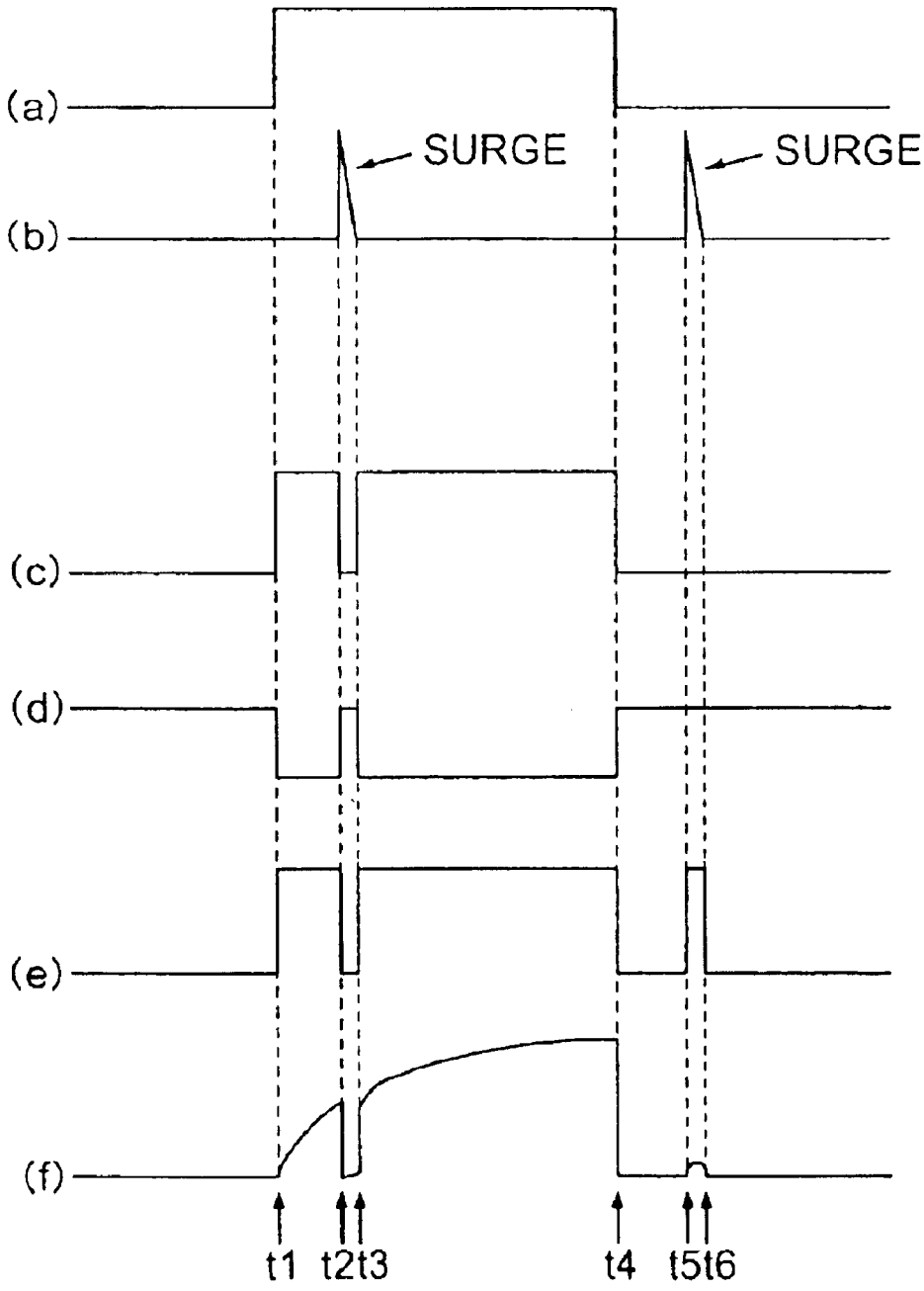

IGNITION DEVICE FOR AN INTERNAL COMBUSTION ENGINE

BACKGROUND OF THE INVENTION

1. Field of the Invention

The present invention relates to an electronic ignition device for an internal combustion engine which is used in ignition of an internal combustion engine such as an automobile.

2. Description of the Related Art

A conventional ignition device for an internal combustion engine is configured in circuit in such a way that a gate of a gate drive type power device (power device) is connected to a power source through a resistor provided outside an integrated circuit (IC), and is pulled up to drive the power device, while a gate current is sunk (pulled down) by an NPN type transistor to turn OFF the power source. In addition, a high voltage cut-off circuit for preventing the power device from being broken down due to the application of an over-voltage is provided in the ignition device for an internal combustion engine.

FIG. 11 is a circuit diagram, partly in block diagram, showing a configuration of a conventional ignition device for an internal combustion engine. Referring now to FIG. 11, an output terminal of a controller (ECU) 1 is connected to a waveform shaping circuit 2, and an output terminal of the waveform shaping circuit 2 is in turn connected to a base terminal of an NPN type transistor 3. A collector terminal of the NPN type transistor 3 is connected to both of a power source pull-up resistor 12 and a terminal (1) of a drive circuit 4.

A terminal (2) of the drive circuit 4 is connected to a gate of a power device (a gate drive type power device) 5 (an IGBT in this case), and a power source 6 is connected to a coil 7. In addition, a power source pull-up resistor 13 provided outside the IC is connected to a terminal (3) of the drive circuit 4.

In addition, a filter circuit constituted by a resistor 9 and a capacitor 10 which are both provided outside the IC is connected to a terminal (4) of a high voltage cut-off circuit 11 for protecting the power device from being broken down due to the load dump.

The high voltage side of the coil 7 is grounded (connected to the ground) through an ignition plug 8. An output terminal (5) of the high voltage cut-off circuit is connected to a output terminal of the waveform shaping circuit 2.

Next, an internal configuration of the drive circuit 4 will hereinbelow be described with reference to FIG. 12. FIG. 12 is a circuit diagram showing an internal configuration of the drive circuit 4 of a conventional ignition device for an internal combustion engine.

Referring now to FIG. 12, the drive circuit 4 includes an NPN type transistor 14 for driving the power device 5, a resistor 15 connected to a gate of the power device 5, and a clamping diode 16 for protecting the power device from suffering the surge. The clamping diode 16 is connected between a collector of the NPN type transistor 14 and the ground (GND).

Next, an internal configuration of the high voltage cut-off circuit 11 will hereinbelow be described with reference to FIG. 13. FIG. 13 is a circuit diagram showing an internal configuration of the high voltage cut-off circuit 11 of a conventional ignition device for an internal combustion engine.

Referring now to FIG. 13, the high voltage cut-off circuit 11 includes a Zener diode 30 and resistors 34 and 35 acting as a circuit for detecting a power source voltage, and a transistor 36 for cutting off a primary current on the basis of the detected power source voltage. By the way, the circuit constituted by the Zener diode 30, the transistors 31 and 33, and the resistor 32 is the circuit for clamping the power source voltage.

Next, the operation of the conventional ignition device for an internal combustion engine will hereinbelow be described with reference to FIG. 14. FIG. 14 is a waveform chart useful in explaining the operation of portions of the conventional ignition device for an internal combustion engine.

Referring now to FIGS. 11, 12 and 14, an ignition signal (a) which has been outputted from the controller 1 is inputted to the waveform shaping circuit 2. Then, the waveform shaping circuit 2 supplies a switching signal (c) to the base terminal of the NPN type transistor 3 to drive the transistor 3.

Subsequently, a switching signal (d) is inputted to the drive circuit 4 through the transistor 3 and the power source pull-up resistor 12.

The NPN type transistor 14 in the drive circuit 4 is switched in accordance with a switching signal (d) which has been inputted to the drive circuit 4 to pull up a current from the power source pull-up resistor 13 mounted outside the IC, thereby outputting a switching signal (e) used to drive the power device 5.

A coil primary current (f) flowing through a primary winding of the coil 7 is caused to flow synchronously with the gate voltage. Then, when this coil primary current (f) is cut off, the voltage is supplied to the ignition plug 8 on the basis of the high voltage generated through a secondary winding of the coil 7 to ignite the ignition plug 8, thereby driving the internal combustion engine.

Note that, the NPN type transistor 14 pulls up a current a quantity of which is determined on the basis of the voltage value of the power source 6 and the resistance value of the power source pull-up resistor 13. The resistance value of the power source pull-up resistor 13 is set in such a way that the NPN type transistor 14 can sufficiently pull up the current with the normal power source voltage.

As described above, in the conventional ignition device for an internal combustion engine, the problem is encountered for example, when the surge generated at the time of switching or the like due to loads of other apparatuses is applied to the power source 6.

FIG. 15 is a waveform chart useful in explaining the operation of portions when a surge is applied. The description will hereinbelow be given with respect to the operation at timing when the ignition signal (a) is at a low level (OFF state) with reference to FIG. 15.

The current which is pulled up by the NPN type transistor 14 is determined on the basis of the voltage value of the power source 6 and the resistance value of the power source pull-up resistor 13. Then, when a surge is applied as shown in FIG. 15, the power source voltage (b) increases at timing of time t5 and hence a quantity of current pulled up by the NPN type transistor 14 increases.

Then, if the current has become unable to be pulled up sufficiently due to the insufficient ability of the NPN type transistor 14, then it becomes impossible to keep the collector voltage (switching signal)(e) of the NPN transistor 14 at a low level, which makes it impossible to reduce the gate voltage of the power device 5.

As a result, there is encountered the problem that the gate voltage increases synchronously with the surge and for a period of time ranging from time t5 to time t6, the malfunction occurs in which the level of the coil primary current (f) is made high (ON state) again.

There is encountered the problem that even if for example, the resistance value of the power source pull-up resistor 13 is made large in order to improve the above-mentioned malfunction, it is impossible to sufficiently drive the power source 5 during the low power source voltage of the power source as in the start-up.

In addition, there is encountered the problem that though increasing the size of the NPN type transistor 14 makes it possible to increase a quantity of pulled up current, the size of the chip increases accordingly.

Next, the description will hereinbelow be given with respect to the operation at timing when the ignition signal (a) is at a high level with reference to FIGS. 13 and 15.

When the surge is applied to the power source 6 at timing of time t2, in the high voltage cut-off circuit 11, the transistor 36 is turned ON through the Zener diode 30, and the resistors 34 and 35.

Since the transistor 36 is connected to the base terminal of the transistor 3, it cuts off the base signal (switching signal) (c) synchronously with the surge. The transistor 3 operates so that the input signal (switching signal) (d) of the drive circuit 4 is inputted to the base terminal of the NPN type transistor 14, and the waveform distortion of the collector voltage (e) of the NPN type transistor 14 is caused to cut off the gate signal of the power device 5.

As a result, there is encountered the problem that the malfunction occurs in which for a period of time from time t2 to time t3, the coil primary current (f) is cut off.

There is also encountered the problem that though in order to improve the above-mentioned malfunction, a capacitor provided outside the IC is included in the power source 6 to configure a filter circuit to absorb the surge, the number of components or parts increases, which leads to the increase in cost.

SUMMARY OF THE INVENTION

The present invention has been made in order to solve the above-mentioned problems, and therefore an object of the present invention to provide an ignition device for an internal combustion engine which is capable of preventing the malfunction of the power device 5 due to the application of an external surge.

In order to attain the above-mentioned object, according to one aspect of the present invention, there is provided an ignition device for an internal combustion engine including, control unit for outputting an ignition signal used to determine a time when an ignition plug should be ignited, switching unit connected to the other terminal of a primary coil for cutting off the flow of a primary current, and drive unit for turning ON or OFF the switching unit in response to the ignition signal to adjust a voltage to be applied to a gate of the switching unit.

Consequently, it is possible to suppress the increase in a gate voltage when an external surge is applied to the power source to prevent the power device from being turned ON again.

Also, there is provided an ignition device for an internal combustion engine including, control unit for outputting an ignition signal used to determine a time when the ignition plug must be ignited, switching unit connected to the other end of the primary winding for cutting off the flow of a primary current, drive unit for turning ON or OFF the switching unit in response to the ignition signal, and high voltage cutting off unit for detecting a voltage value of the power source to cut off the flow of the primary current when the voltage value has reached a predetermined voltage. The high voltage cutting off unit includes cut-off delaying unit for delaying the cut-off by a predetermined time, and after a lapse of a predetermined time after the voltage value had reached a predetermined voltage, the primary current is cut off.

As a result, the highly reliable protection can be realized against any of such surges each having a high frequency and a high peak.

BRIEF DESCRIPTION OF THE DRAWINGS

The above and other objects as well as advantages of the present invention will become clear by the following description of the preferred embodiments of the present invention with reference to the accompanying drawings, wherein:

FIG. 11 is a circuit diagram, partly in block diagram, showing a configuration of a conventional ignition device for an internal combustion engine;

FIG. 12 is a circuit diagram showing a configuration of a conventional drive circuit;

FIG. 13 is a circuit diagram showing a configuration of a conventional high voltage cut-off circuit;

FIG. 14 is a waveform chart useful in explaining the operation of the conventional ignition device for an internal combustion engine; and FIG. 15 is a waveform chart useful in explaining the operation of the conventional ignition device for an internal combustion engine.

DETAILED DESCRIPTION OF THE PREFERRED EMBODIMENTS

The preferred embodiments of the present invention will hereinafter be described in detail with reference to the accompanying drawings.

(First Embodiment)

A first embodiment according to the present invention will hereinbelow be described in detail with reference to FIGS. 1 and 2.

Figure 1:
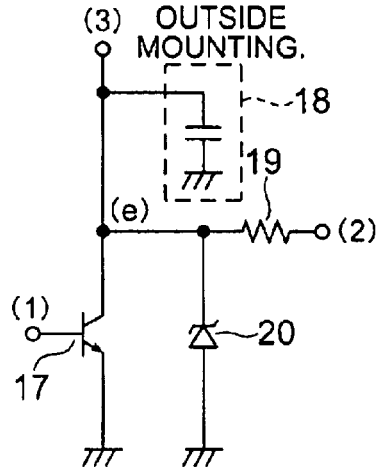
FIG. 1 is a circuit diagram showing a configuration of a drive circuit in a first embodiment according to the present invention.

FIG. 1 is a circuit diagram showing a structure of a drive circuit 4 in a first embodiment according to the present invention. Note that, since in a device, the constituent elements other than a drive circuit are the same as those in the conventional device (refer to FIGS. 11 and 13), these constituent elements are designated by the same reference numerals and hence the detailed description thereof is omitted here for the sake of simplicity.

Referring now to FIG. 1, the drive circuit 4 includes an NPN type transistor 17 for driving a power device 5, a capacitor 18 which is provided together with a power source pull-up resistor 13 in the outside of an IC in order to constitute a filter circuit, a resistor 19 connected to a gate of the power device 5, and a clamping diode 20 connected between a collector of the NPN transistor 17 and the ground for protecting the power device 5 from suffering any of surges.

Next, the operation in the first embodiment according to the present invention will hereinbelow be described with reference to FIG. 2. FIG. 2 is a waveform chart useful in explaining the operation in the first embodiment according to the present invention.

Figure 2:
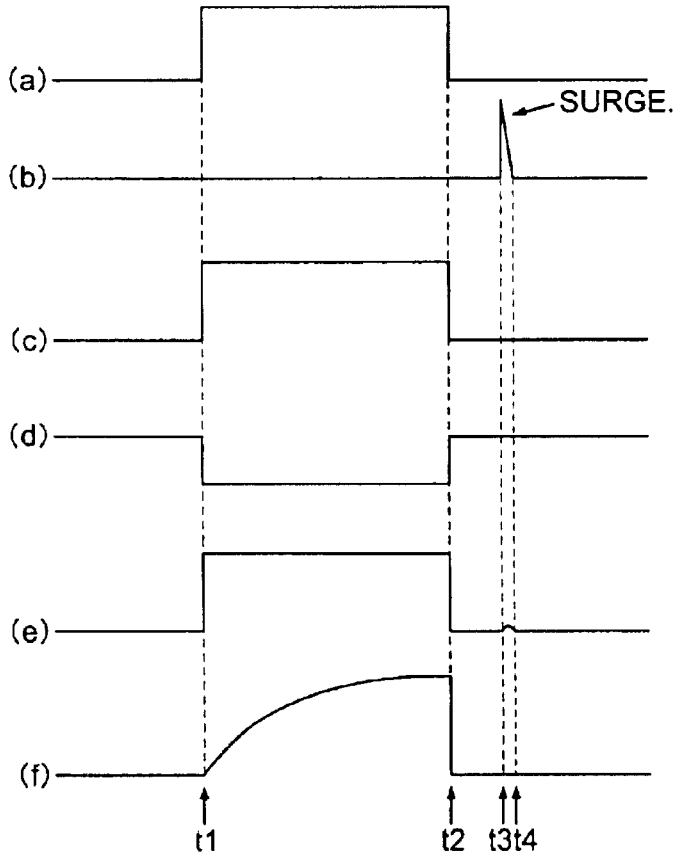
FIG. 2 is a waveform chart useful in explaining the operation in the first embodiment according to the present invention.

Referring to FIG. 2, if the surge is applied to the power source 6 when an ignition signal (a) from an CU 1 is at low level, then the surge will be applied to a power source pull-up resistor 13 (refer to a power source voltage (b) (for a period of time for t3 to t4).

The surge which has been applied to the power source pull-up resistor 13 is then absorbed in the filter circuit constituted of the power source pull-up resistor 13 and the capacitor 18.

Consequently, the increase in collector voltage (e) of the transistor 17 is suppressed and hence there is no increase in gate voltage of the power device 5 so that the coil primary current (f) can be kept at a low level without making the level thereof high again.

In such a manner, the filter circuit constituted of the power source pull-up resistor 13 and the capacitor 18 is added to the outside of the IC, whereby it is possible to suppress the increase in gate voltage of the power device 5 and also it is possible to prevent the power device 5 from being turned ON again when the external surge is applied to the power source 6.

(Second Embodiment)

Note that, in the first embodiment, a surge is absorbed by the filter circuit constituted of the resistor and the capacitor. Alternatively, however, ON and OFF of the transistor may be switched over to each other in accordance with the ignition signal to adjust a current a quantity which is pulled up by the transistor.

Figure 3:
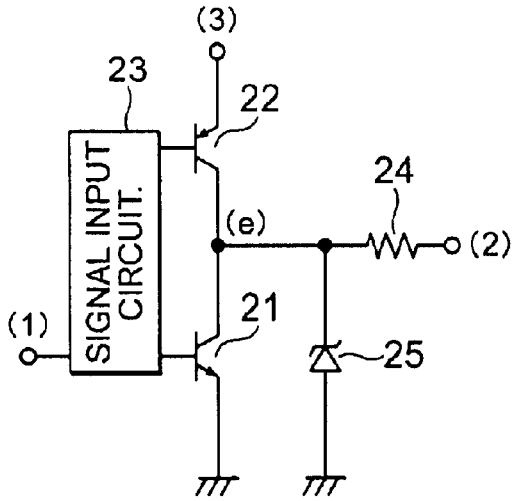
FIG. 3 is a circuit diagram showing a configuration of a drive circuit in a second embodiment according to the present invention.

FIG. 3 is a circuit diagram showing a structure of a drive circuit 4 in a second embodiment according to the present invention. Note that, since in a device, the constituent elements other than a drive circuit are the same as those in the conventional device (refer to FIGS. 11 and 13), these constituent elements are designated by the same reference numerals and hence the detailed description thereof is omitted here for the sake of simplicity.

Referring now to FIG. 3, a drive circuit 4 includes a sink side transistor 21 and a source side transistor 22 for driving a power device 5, a signal input circuit 23 for switching ON and OFF of the sink side transistor 21 and the source side transistor 22 over to each other in accordance with an ignition signal outputted from an ECU 1, a resistor 24 connected to a gate of the power device 5, and a clamping diode 25 connected between a collector of the sink side transistor 21 and the ground for protecting the power device 5 from suffering any of such surges.

Figure 4:
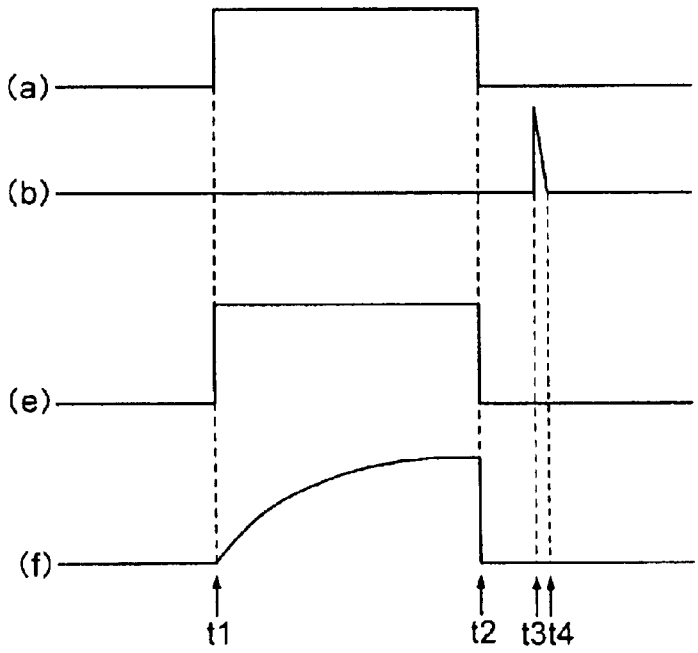
FIG. 4 is a waveform chart useful in explaining the operation in the second embodiment according to the present invention.

Next, the operation in the second embodiment according to the present invention will hereinbelow be described with reference to FIG. 4. FIG. 4 is a waveform chart useful in explaining the operation in the second embodiment according to the present invention.

Referring now to FIG. 4, if a surge is applied to the power source 6 at timing when the ignition signal (a) from the ECU 1 is at a low level (refer to a power source voltage (b) for a period of time from t3, to t4), then the surge will be applied to the power source pull-up resistor 13.

The signal input circuit 23, at timing when the ignition signal (a) is being at a high level, turns OFF the sink side transistor 21, while turns ON the source side transistor 22. On the other hand, at timing when the ignition signal is being at a low level, the signal input circuit 23 turns ON the sink side transistor 21, while turns OFF the source side transistor 22.

Since at timing when the surge is applied thereto, the ignition signal (a) is being at a low level, while the source side transistor 22 is being in an OFF state, the current pulled up by the sink side transistor 21 is only the gate current of the power device 5.

As a result, since the sink side transistor 21 is prevented from pulling up the over-current caused by the application of the surge and hence there is no increase in collector voltage (e), the coil primary current (f) can be kept at a low level without making the level thereof high again.

In such a manner, the push-pull circuit structure is adopted in which the source side transistor is provided in the drive circuit 4, and ON and OFF of the transistor can be switched over to each other in accordance with the ignition signal, whereby it is possible to control the increase in gate voltage when an external surge is applied to the power source 6. As a result, the power device 5 can be prevented from being turned ON again and hence it is unnecessary to add any of capacitors to the outside of the IC. Also, the reduction in cost due to the reduction of the number of components or parts becomes possible.

(Third Embodiment)

Note that, in the first embodiment, a surge is absorbed by the circuit constituted of the resistor and the capacitor; Alternatively, however, a quantity of current to the transistor for pulling up the current may be limited using a resistor and a clamping diode.

Figure 5:
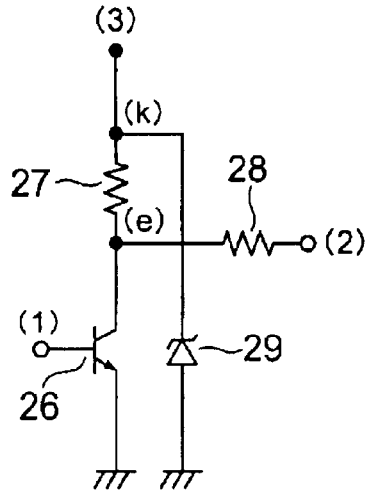
FIG. 5 is a circuit diagram showing a configuration of a drive circuit in a third embodiment according to the present invention.

FIG. 5 is a circuit diagram showing a structure of a drive circuit 4 in a third embodiment according to the present invention. Note that, since in a device, the constituent elements other than a drive circuit are the same as those in the conventional device (refer to FIGS. 11 and 13), these constituent elements are designated by the same reference numerals and hence the detailed description thereof is omitted here for the sake of simplicity.

Referring to FIG. 5, a drive circuit 4 includes a transistor 26 for driving a power device 5, a current limiting resistor 27 connected between a power source pull-up resistor 13 and a collector of the transistor 26, a resistor 28 connected to a gate of the power device 5, and a clamping diode 29 connected between a connection portion between the power source pull-up resistor 13 and the current limiting resistor 27, and the ground for the surge protection.

Figure 6:
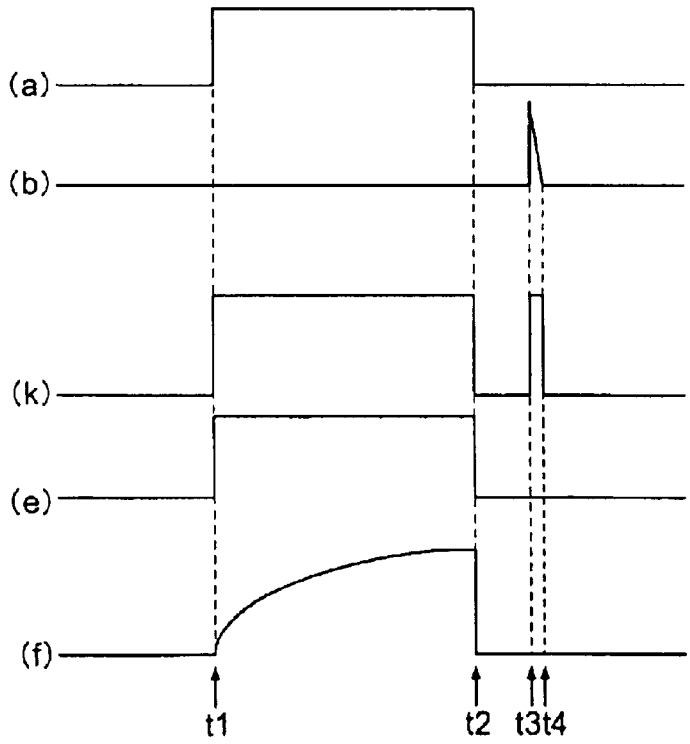
FIG. 6 is a waveform chart useful in explaining the operation in the third embodiment according to the present invention.

Next, the operation in the third embodiment of the present invention will hereinbelow be described with reference to FIG. 6. FIG. 6 is a waveform chart useful in explaining the operation in the third embodiment according to the present invention.

Referring to FIG. 6, if a surge is applied to the power source 6 at timing when an ignition signal (a) from an ECU 1 is at a low level (refer to a power source voltage (b) for a period of time from t3, to t4), then a surge is applied to the power source pull-up resistor 13 so that a voltage (k) developed across the power source pull-up resistor 13 and the current limiting resistor 27 increases.

The resistance value of the current limiting resistor 27 is set in such a way that the transistor 26 can sufficiently pulled up the current which is determined on the basis of the voltage difference between a collector voltage (e) of the transistor 26 and the voltage (k), and the resistance value of the current limiting resistor 27, whereby it is possible to keep the collector voltage (e) at a low level.

As a result, the gate voltage of the power device 5 can be kept at a low level without making the gate voltage of the power device 5 high and the coil primary current (f) can be kept at a low level and without making the level of the coil primary current (f) high again.

In such a manner, the clamping diode 29 and the current limiting resistor 27 are both connected in the after stage of the power source pull-up resistor 13 provided outside the IC to limit a quantity of current flowing through the transistor 26 for pulling up the gate current of the power device 5, whereby it is possible to suppress the increase in gate voltage and also it is possible to prevent the power device 5 from being turned ON again when an external surge is applied to the power source 6.

In addition, there is no necessity of adding any of capacitors to the outside of the IC and hence it is possible to reduce the cost due to the reduction in the number of components or parts.

Also, since there is no voltage drop in driving the power device and hence it is possible to drive the power device 5 with a low voltage, it is possible to enhance the reliability.

(Fourth Embodiment)

Note that, while no reference has been made to the high voltage cut-off circuit 11 in the first to third embodiments at all, a cut-off delay circuit for delaying the cut-off operation by a predetermined time may be provided in the high voltage cut-off circuit 11.

Figure 7:
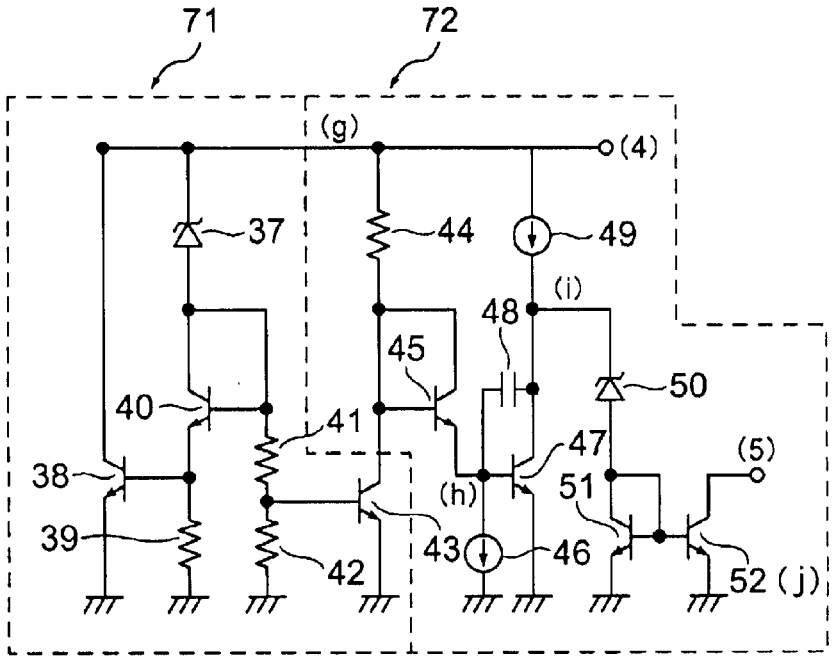
FIG. 7 is a circuit diagram showing a configuration of a high voltage cut-off circuit in a fourth embodiment according to the present invention.

Next, the description will hereinbelow be given with respect to the case where a delay time is set in the high voltage cut-off circuit 11 with reference to FIG. 7. FIG. 7 is a circuit diagram showing a structure of a fourth embodiment according to the present invention. Note that, since the circuit structure of the circuits is the same as that of the above-mentioned embodiments (refer to FIGS. 1, 3, 5, 11 and 12) except for the high voltage cut-off circuit, the constituent elements constituting these circuits are designated by the same reference numerals and the detailed description is omitted here for the sake of simplicity.

Referring now to FIG. 7, the high voltage cut-off circuit 11 includes a power source voltage detecting circuit 71 for detecting a voltage of the power source 6 to transmit a signal to a delay circuit, and a cut-off delay circuit 72 for delaying the cut-off operation of the coil primary current by a predetermined time.

The power source voltage detecting circuit 71 includes a Zener diode 37 and resistors 41 and 42 for detecting the power source voltage, and a transistor 43 for transmitting a signal to a cut-off delay circuit 72. In addition, the circuit constituted of the Zener diode 33, and the transistors 38 and 40, and the resistor 39 is the circuit for clamping the power source voltage.

The cut-off delay circuit 72 includes transistors 45 and 47 each of which is normally in an ON state with the power source pull-up resistor 44, a constant current source 46 connected to a base of a transistor 47 for determining a delay time, a capacitor 48 connected between a base and a collector of the transistor 47, a constant current source 49 and a Zener diode 50 which are both connected to the collector of the transistor 47, and current mirror circuits 51 and 52 constituted of transistors 51 and 52 for transmitting a cut-off signal to the after stage.

Figure 8:
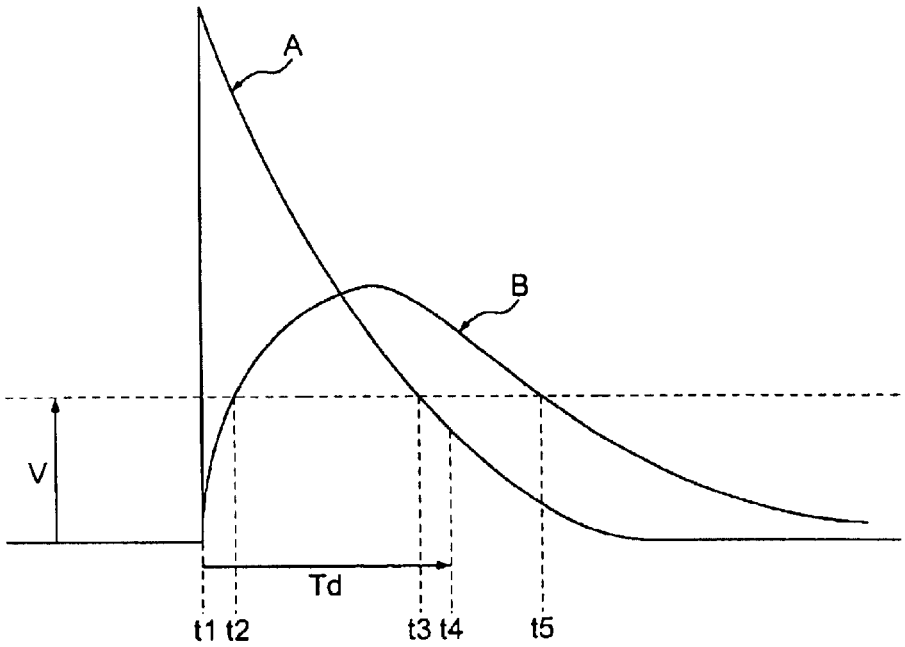
FIG. 8 is a waveform chart useful in explaining the operation in the fourth embodiment according to the present invention.

Next, the description will hereinbelow be given with respect to the operation when an instantaneous surge is applied to the power source 6 with reference to FIGS. 8 and 9. FIG. 8 is a waveform chart useful in explaining the relationship between the power source voltage and the cut-off voltage, and FIG. 9 is a waveform chart useful in explaining the operations of portions when an instantaneous surge is applied to the power source 6.

Referring now to FIG. 8, when a surge A is applied to the power source 6 at timing of time t1, conventionally, the surge is absorbed by the filter circuit provided in the power source portion to make the surge become dull to obtain a waveform B. Now, when the level of the power source voltage is not suppressed so as to be equal to or lower than the cut-off voltage V even if the surge is absorbed, the high voltage cut-off circuit 11 continues to cut off the coil primary current for a period of time from time t2 to time t5.

On the other hand, the masking is continued to be carried out by time t4 delayed by a delay time Td for the surge A in order to delay the cut-off of the coil primary current by a predetermined time period to disable the cut-off function until a lapse of time t4. As a result, since even when the cut-off voltage is continued to be applied by time t3, even if the power source voltage becomes equal to or lower than the cut-off voltage V until a lapse of time t4, no cut-off function serves, no coil primary current is cut off at all.

Figure 9:
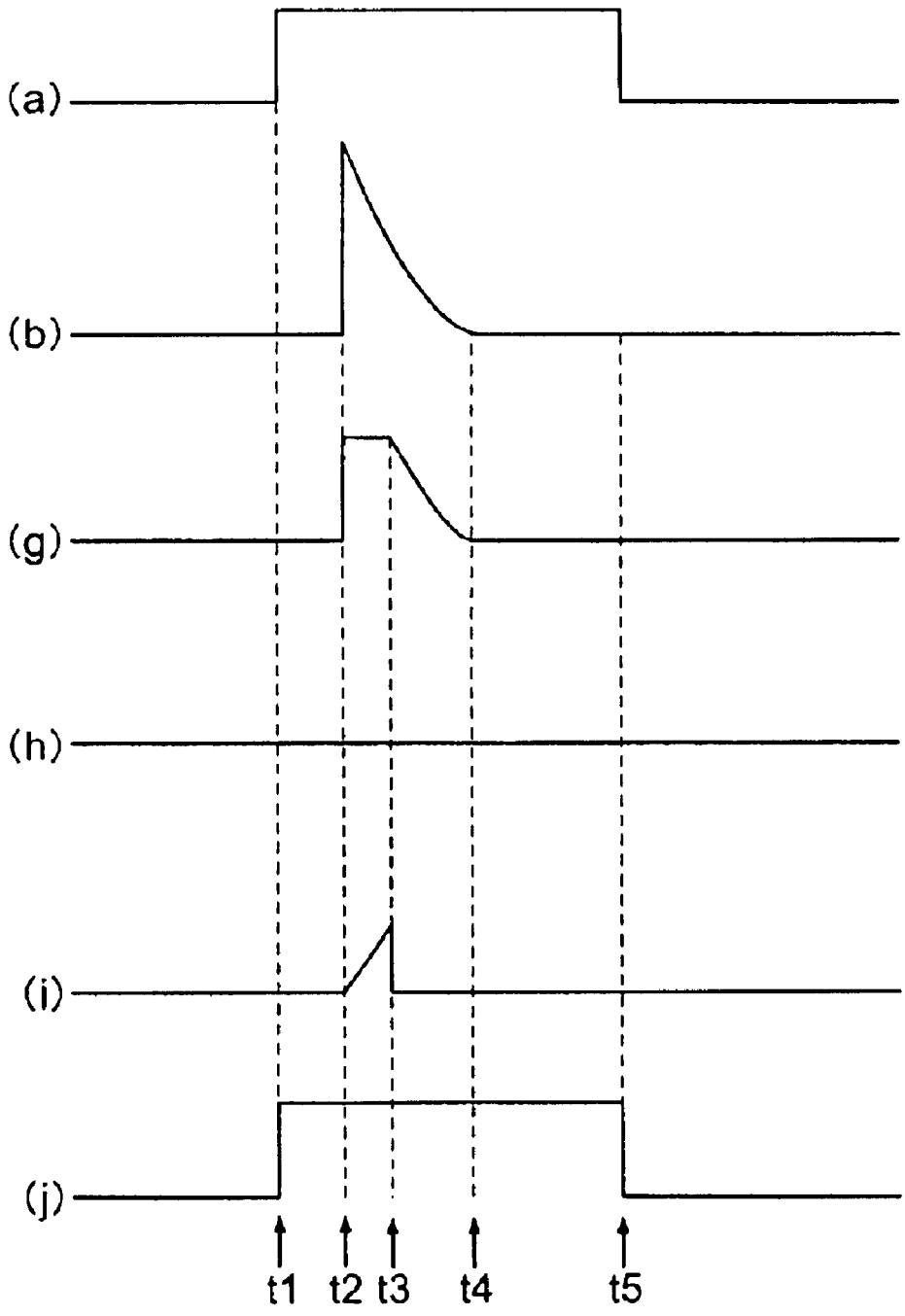
FIG. 9 is a waveform chart useful in explaining the operation in the fourth embodiment according to the present invention.

Referring to FIG. 9, in the steady state, when both of the transistors 45 and 47 have been turned ON, the collector voltage (i) of the transistor 47 is reduced, and the current mirror circuits 51 and 52 are in an OFF state.

When the power source voltage (b) has increased at timing of time t2 due to the application of a surge, first of all, the transistor 43 is turned ON through the Zener diode 37, and the resistors 41 and 42. Thereafter, the power source voltage (g) is clumped by the Zener diode 37, the transistors 38 and 40, and the resistor 39.

While when the transistor 43 has been turned ON, the base signal (h) of the transistor 47 is intended to be cut off, after waiting for a lapse of predetermined delay time Td, a base signal (h) of the transistor 47 is cut off to turn OFF the transistor 47. This circuit is a delay circuit utilizing the integrating circuit.

This delay time Td, as expressed by Expression (1), is determined on the basis of the capacitance value of the capacitor 48, the constant current of the constant current source 46, and the collector voltage of the transistor 47.

$$\text{Delay Time } TD = C \times Vz / I \quad (1)$$

where C is the capacitance value of the capacitor 48, Vz is the clamping voltage and I is the constant current of the constant current source 46.

When a period of time until the transistor 43 has been turned ON is shorter than the delay time Td due to the operation of the cut-off delay circuit 72, a collector voltage (i) of the transistor 47 does not reach the clamping voltage Vz of the Zener diode 50 and hence it is impossible to turn ON the current mirror circuits 51 and 52 constituted of the transistors 51 and 52 in the after stage.

Consequently, an output signal (j) of the current mirror circuits 51 and 52 is transmitted to the after stage in just the state in which it is kept as the output signal of the waveform shaping circuit 2 received the ignition signal (a) from the ECU 1.

In such a manner, the high voltage cut-off circuit is provided with the function of when an external surge is applied to the power source 6, cutting off the primary current after a lapse of predetermined time after detecting the power source voltage, whereby it is possible to realize the highly reliable protection against any of surges each having a high frequency and a high peak.

Figure 10:
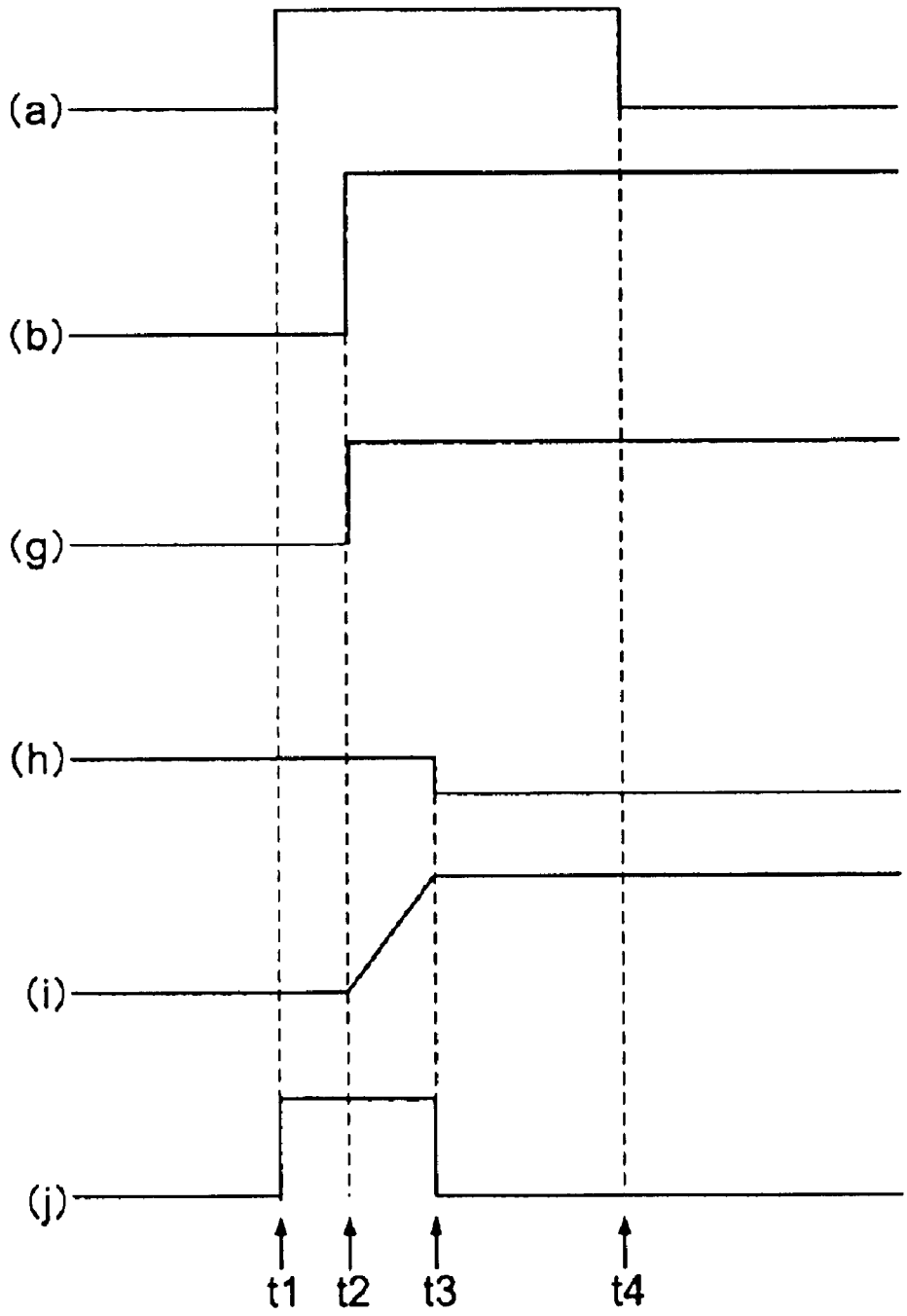
FIG. 10 is a waveform chart useful in explaining the operation in the fourth embodiment according to the present invention.

FIG. 10 is a waveform chart useful in explaining the operations of portions when an over-voltage is applied though a predetermined time has elapsed, e.g., when a load damp is applied.

Referring now to FIG. 10, when the power source voltage (b) has increased at timing of time t2, first of all, the transistor 43 is turned ON through the Zener diode 37, and the resistors 41 and 42. Thereafter, the power source voltage (g) is clamped by the Zener diode 37, the transistors 38 and 40, and the resistor 39.

While when the transistor 43 has been turned ON, the base signal (h) of the transistor 47 is intended to be cut off, after the operation is delayed by the delay time which as expressed in Expression (1), is determined on the basis of the capacitance value of the capacitor 48, the constant current of the constant current source 46 and the collector voltage of the transistor 47 (=the clamp voltage of the clamping diode 50), the base signal (h) of the transistor 47 is cut-off at timing of time t3 to turn OFF the transistor 47.

A collector voltage (i) of the transistor 47 has reached the clamp voltage Vz of the Zener diode 50 to turn ON the current mirror circuits 51 and 52 provided in the after stage.

As a result, an output signal (j) from the current mirror circuits 51 and 52 cuts off the output signal of the waveform shaping circuit 2 synchronous with the ignition signal (a) at time t3, which is delayed from a time point t2 when the surge is applied by the delay time Td.

In such a manner, the circuit for determining the delay time is provided in the high voltage cut-off circuit 11 within the IC, whereby conventionally, the capacitance of 0.1 uF is required for the capacitor of the power source portion, whereas in the present invention, the capacitance of several tens pF may be available therefor, and hence it is possible to extremely reduce the capacitance of the capacitor.

As a result, the capacitor of the filter circuit provided in the power source portion provided outside the IC can be removed and hence it is possible to reduce the cost due to the reduction in the number of components or parts.

As described above, according to the present invention, there is provided an ignition device for an internal combustion engine including, control means for outputting an ignition signal used to determine a time when an ignition plug should be ignited, switching means connected to the other terminal of a primary coil for cutting off the flow of a primary current, and drive means for turning ON or OFF the switching means in response to the ignition signal to adjust a voltage to be applied to a gate of the switching means. Consequently, there is offered the effect that it is possible to obtain an ignition device for an internal combustion engine which is capable of suppressing the increase in gate voltage when an external surge is applied to the power source to prevent the power device from being turned ON again.

In addition, according to the present invention, since the drive means includes the filter means for absorbing a surge generated in the voltage of the power source, there is offered the effect that it is possible to obtain an ignition device for an internal combustion engine which is capable of suppressing the increase in gate voltage when an external surge is applied to the power source to prevent a power device from being turned ON again.

In addition, according to the present invention, the drive means includes the push-pull circuit for connecting or disconnecting the power source and the switching means to each other or from each other in response to the level (high or low) of the ignition signal of the ignition plug. Consequently, there is offered the effect that it is possible to obtain an ignition device for an internal combustion engine which is capable of suppressing the increase in gate voltage when an external surge is applied to a power source to prevent a power device from being turned ON again and of reducing the cost due to the reduction in the number of components or parts since there is no necessity of adding any of capacitors to the outside of an IC.

Also, according to the present invention, the drive means includes the current limiting means for limiting a quantity of current to adjust the current to be supplied to the gate of the switching means in accordance with the voltage of the power source. Consequently, there is offered the effect that it is possible to obtain an ignition device for an internal combustion engine which is capable of suppressing the increase in gate voltage when an external surge is applied to a power source to prevent a power device from being turned ON again and of reducing the cost due to the reduction in the number of components or parts to enhance the reliability.

Also, according to the present invention, there is provided an ignition device for an internal combustion engine including, control means for outputting an ignition signal used to determine time when the ignition plug must be ignited, switching means connected to the other end of the primary winding for cutting off the flow of a primary current, drive means for turning ON or OFF the switching means in response to the ignition signal, and high voltage cutting off means for detecting a voltage value of the power source to cut off the flow of the primary current when the voltage value has reached a predetermined voltage. The high voltage cutting off means includes, cut-off delaying means for delaying the cut-off by a predetermined time, and after a lapse of a predetermined time after the voltage value had reached a predetermined voltage, the primary current is cut off. As a result, there is offered the effect that it is possible to obtain an ignition device for an internal combustion engine in which the highly reliable protection can be realized against any of such surges each having a high frequency and a high peak.

Furthermore, according to the present invention, the cut-off delay means is structured together with the high voltage cut-off means in a single IC. Consequently, there is offered the effect that it is possible to obtain an ignition device for an internal combustion engine which is capable of reducing extremely a capacitance value of a capacitor to allow a capacitor in a power source portion provided outside an IC to be removed and hence of reducing the cost due to the reduction in the number of components or parts.

While the present invention has been particularly shown and described with reference to the preferred embodiments, it will be understood that the various changes and modifications will occur to those skilled in the art without departing from the scope and true spirit of the invention. The scope of the invention is, therefore, to be determined solely by the appended claims.

What is claimed is:

1. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

control means for outputting an ignition signal used to determine a time when an ignition plug should be ignited;

switching means connected to the other terminal of a primary coil for cutting off the flow of a primary current;

drive means for turning ON or OFF the switching means in response to the ignition signal to adjust a voltage to be applied to a gate of the switching means; and filter means, external to the drive means, for absorbing a surge generated in the voltage of said power source.

2. An ignition device for an internal combustion engine according to claim 1, wherein said ignition device further comprises a power source pull-up resistor connected between said power source and said drive means, said filter means comprises a capacitor, and said pull-up resistor and said capacitor constitute a filter.

3. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

control means for outputting an ignition signal used to determine a time when an ignition plug should be ignited;

switching means connected to the other terminal of a primary coil for cutting off the flow of a primary current; and drive means for turning ON or OFF the switching means in response to the ignition signal to adjust a voltage to be applied to a gate of the switching means, wherein said drive means includes a push-pull circuit for connecting or disconnecting said power source and said switching means to each other or from each other in accordance with a level of an ignition signal from said ignition plug.

4. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

control means for outputting an ignition signal used to determine a time when an ignition plug should be ignited;

switching means connected to the other terminal of a primary coil for cutting off the flow of a primary current; and drive means for turning ON or OFF the switching means in response to the ignition signal to adjust a voltage to be applied to a gate of the switching means, wherein said drive means includes current limiting means for limiting a quantity of current to adjust a current to be supplied to the gate of said switching means in accordance with the voltage of said power source, said current limiting means being provided in an after stage of a power source pull-up resistor which is connected between said power source and said drive means.

5. An ignition device for an internal combustion engine according to claim 4, wherein said current limiting means comprises a diode and a current limiting resistor connected in parallel, and said diode and said current limiting resistor are connected in the after stage of said power source pull-up resistor.

6. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

control means for outputting an ignition signal used to determine a time when said ignition plug must be ignited;

switching means connected to the other end of said primary winding for cutting off the flow of a primary current;

drive means for turning ON or OFF said switching means in response to the ignition signal; and high voltage cutting off means for detecting a voltage value of said power source to cut off the flow of the primary current when the voltage value has reached a predetermined voltage, said high voltage cutting off means including:

cut-off delaying means for delaying the cut-off by a predetermined time, wherein after a lapse of a predetermined time after the voltage value had reached a predetermined voltage, the primary current is cut off.

7. An ignition device for an internal combustion engine according to claim 6, wherein said cut-off delaying means is configured together with said high voltage cutting-off means in a single integrated circuit.

8. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

a control circuit which outputs an ignition signal used to determine a time when an ignition plug should be ignited;

a switching circuit which is connected to the other terminal of a primary coil and cuts off the flow of a primary current;

a driving circuit which turns ON or OFF the switching circuit in response to the ignition signal to adjust a voltage to be applied to a gate of the switching means; and a filter circuit, external to the driving circuit, for absorbing a surge generated in the voltage of said power source.

9. An ignition device for an internal combustion engine according to claim 8, wherein said ignition device further comprises a power source pull-up resistor connected between said power source and said driving circuit, said filter circuit comprises a capacitor, and said pull-up resistor and said capacitor constitute a filter.

10. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

a control circuit which outputs an ignition signal used to determine a time when an ignition plug should be ignited;

a switching circuit which is connected to the other terminal of a primary coil and cuts off the flow of a primary current; and a driving circuit which turns ON or OFF the switching circuit in response to the ignition signal to adjust a voltage to be applied to a gate of the switching means;

wherein said driving circuit includes a push-pull circuit which connects or disconnects said power source and said switching circuit to each other or from each other in accordance with a level of an ignition signal from said ignition plug.

11. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

a control circuit which outputs an ignition signal used to determine a time when an ignition plug should be ignited;

a switching circuit which is connected to the other terminal of a primary coil and cuts off the flow of a primary current; and a driving circuit which turns ON or OFF the switching circuit in response to the ignition signal to adjust a voltage to be applied to a gate of the switching means, wherein said driving circuit includes a current limiting circuit which limits a quantity of current to adjust a current to be supplied to the gate of said switching circuit in accordance with the voltage of said power source, said current limiting circuit being provided in an after stage of a power source pull-up resistor which is connected between said power source and said driving circuit.

12. An ignition device for an internal combustion engine according to claim 11, wherein said current limiting circuit comprises a diode and a current limiting resistor connected in parallel, and said diode and said current limiting resistor are connected in the after stage of said power source pull-up resistor.

13. An ignition device for an internal combustion engine in which a power source is connected to one end of a primary winding of an ignition coil mounted to said internal combustion engine, an ignition plug is connected to one end of a secondary winding of said ignition coil and the current flow through said primary winding is cut off to supply a high voltage generated through said secondary winding to said ignition plug, said ignition device comprising:

a control circuit which outputs an ignition signal used to determine a time when an ignition plug should be ignited;

a switching circuit which is connected to the other terminal of a primary coil and cuts off the flow of a primary current;

a driving circuit which turns ON or OFF the switching circuit in response to the ignition signal to adjust a voltage to be applied to a gate of the switching means; and a high voltage cutting-off circuit which detects a voltage value of said power source to cut off the flow of the primary current when the voltage value has reached a predetermined voltage, said high voltage cutting off circuit comprising:

a delay circuit which delays the cut-off by a predetermined time, wherein after a lapse of a predetermined time after the voltage value had reached a predetermined voltage, the primary current is cut off.

14. An ignition device for an internal combustion engine according to claim 13, wherein said delaying circuit is configured together with said high voltage cutting-off circuit in a single integrated circuit.

* * * * *